US007137755B2

(12) United States Patent
Norman et al.

(10) Patent No.: US 7,137,755 B2
(45) Date of Patent: Nov. 21, 2006

(54) UNDERGROUND WATER RETENTION APPARATUS

(76) Inventors: Jeffrey J. Norman, 4730 E. Charleston Ave., Phoenix, AZ (US) 85032; James A. Mayer, 1824 E. Gardenia Ave. #179, Phoenix, AZ (US) 85020

( * ) Notice: Subject to any disclaimer, the term of this patent is extended or adjusted under 35 U.S.C. 154(b) by 536 days.

(21) Appl. No.: 09/912,289

(22) Filed: Jul. 24, 2001

(65) Prior Publication Data

US 2003/0021630 A1 Jan. 30, 2003

(51) Int. Cl.
*E02B 13/00* (2006.01)

(52) U.S. Cl. ..... 405/52; 405/36

(58) Field of Classification Search ..... 405/36, 405/37, 38, 39, 52, 53; 404/2, 4; 52/302.1, 52/302.3

See application file for complete search history.

(56) References Cited

U.S. PATENT DOCUMENTS

| | | | | |
|---|---|---|---|---|
| 2,701,027 | A * | 2/1955 | Scoville | 210/163 |
| 3,950,252 | A * | 4/1976 | Jordan et al. | 405/36 X |
| 4,298,294 | A * | 11/1981 | Zimmerman | 405/37 |
| 6,095,718 | A * | 8/2000 | Bohnhoff | 405/52 |
| 6,419,421 | B1 * | 7/2002 | Whitfield, Jr. | 405/36 |

* cited by examiner

*Primary Examiner*—Sunil Singh
(74) *Attorney, Agent, or Firm*—H. Gordon Shields

(57) ABSTRACT

Apparatus for receiving run off water in shopping centers and the like includes an underground storage area from which the stored water percolates into the local aquifer or is pumped out, as desired or as required. Several embodiments of perimeter support structures are illustrated. In one embodiment, a retaining wall is used to support structural tee elements, and in another embodiment caissons are spaced apart and receive L-beams which in turn support structural tee elements. Other embodiments show full vertical walls and stepped walls. The tee elements may be used to support a parking area for vehicles or to provide support for other appropriate uses. An appropriate liner is secured to the perimeter support structure for holding the run off water.

24 Claims, 9 Drawing Sheets

UNDERGROUND WATER RETENTION APPARATUS

BACKGROUND OF THE INVENTION

1. Field of the Invention

This invention relates to water storage facilities and, more particularly, to underground storage facilities for retaining or detaining run off water on property being developed, such as shopping malls and the like.

2. Description of the Prior Art

U.S. Pat. No. 3,991,900 (Burke et al) discloses the use of a flexible sheet of fluid impervious material as a cover for the side walls and bottom of a reservoir. The flexible sheet is secured to the upper periphery of the reservoir.

U.S. Pat. No. 4,457,646 (Laesch) discloses a reservoir system which includes diversion elements with conduits extending from a reservoir to drainage areas.

U.S. Pat. No. 4,786,205 (Hisken et al) discloses a collection system for collecting water. The system includes trough elements at the periphery of a basic structure to allow animals to drink.

U.S. Pat. No. 5,246,308 (Brothers) discloses a type of domed reservoir in which the bottom and side walls of the reservoir are lined with a flexible membrane. A fan is used to provide air under pressure to keep the dome above the surface of the fluid.

U.S. Pat. No. 5,249,887 (Phillips) discloses a control system for controlling the flow of liquid from a site to a drainage area. A plurality of cells are connected together, and fluid flow between the cells is controlled.

U.S. Pat. No. 5,342,144 (McCarthy) discloses a water control system for collecting and controlling the flow of a collection reservoir into a drainage area.

U.S. Pat. No. 5,360,290 (Yamada et al) discloses an underground drainage system which includes pumps and conduits for channeling water collected from various elements to a drainage facility.

U.S. Pat. Nos. 5,487,621 and 5,909,982 (Takada et al) disclose a system similar to the previously discussed '290 patent. These patents pertain to the control of drain water from a metropolitan area through underground channels.

None of these patents directly refer to storage facilities, per se, in which rain water or melt water is stored after being collected and concentrated underground.

In many locations, contemporary laws require that water falling onto specific areas be managed. That is, rain water falling onto a developed property area, such as a shopping mall, must be kept on the property and must not be allowed to drain to adjacent properties. The apparatus of the present invention provides underground storage facilities for such run off water and provides a useful benefit, namely a parking area or any hard surfaced facility, to be built over the water storage apparatus. The present invention is opposed to, for example, water retention basins which may occupy a substantial amount of land, with very little practical benefit and underground pipes. A danger of such retention basins is, of course, the possibility of a child falling into the retention basin and becoming a drowning victim, or a health hazard, etc., and a problem with underground pipes, in addition to cost, is also a possible health hazard.

SUMMARY OF THE INVENTION

The invention described and claimed herein comprises an underground storage facility for storing run off water, either from rain or from melting snow, with the area above the water storage facility being able to be used for a hard surfaced facility, such as parking lot or other facility. From the water storage apparatus, the water is either drained into dry wells from which the water ultimately flows into a local aquifer or is pumped out to the surface or to an existing storm drain system, as required. Several embodiments are disclosed, including embodiments with retaining walls disposed about the perimeter of the water retention apparatus to and an embodiment without a retaining wall but with caissons at the perimeter to support L beams.

Among the objects of the present invention are the following:

To provide new and useful water storage facilities;

To provide new and useful underground water storage facilities;

To provide new and useful underground water storage apparatus having a hard surfaced facility on top of the storage apparatus;

To provide new and useful water storage apparatus including dry wells;

To provide new and useful underground water storage facilities having pumps for pumping water out of the facilities;

To provide new and useful water storage facilities having flexible liners;

To provide new and useful water storage apparatus having a relatively inflexible liner;

To provide new and useful underground water storage facilities having perimeter support walls;

To provide new and useful underground water storage facilities including structural elements supported by spaced apart caissons; and To provide new and useful apparatus for storing water underground and having stepped perimeter support walls.

DESCRIPTION OF THE PREFERRED EMBODIMENT

Figure 1:
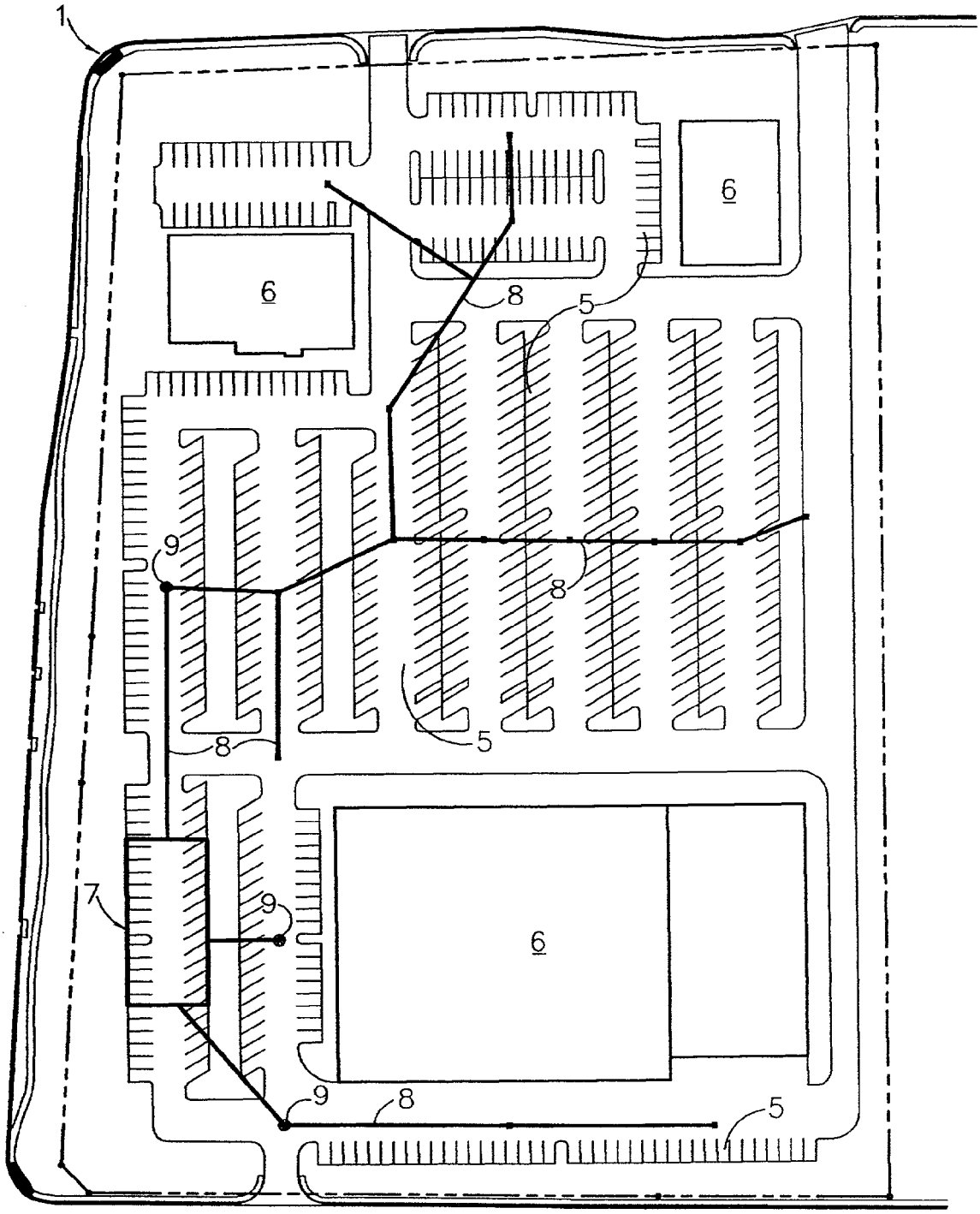
FIG. 1 is a plan view of the apparatus of the present invention in its use environment.

FIG. 1 is a plan view showing water retention apparatus of the present invention in its use environment. The use environment includes a shopping center site 1 and the associated structures involved in the shopping center 1, including multiple parking areas 5, multiple shopping structures or buildings 6, a water retention apparatus or structure outline 7, which is disposed beneath a portion of a parking area 5.

FIG. 1 also includes water input or drain lines 8 and dry wells 9 for the site 1 which drain run off water into the apparatus 7, as will be explained in detail below. For convenience, the water retention apparatus 7 and the drain lines 8 and dry wells 9 are shown bolded in FIG. 1.

In FIG. 1, the top of the water retention apparatus or structure 7 is shown disposed beneath a portion of the parking areas 5, but other uses may be made of the top of the apparatus 7, as has been mentioned. For convenience in understanding the water retention or retaining apparatus of the present invention, the representation of the structure 7 in FIG. 1 is illustrative of the use environment of the present invention. While the retention apparatus 7 is outlined in FIG. 1, with respect to the overall site 1, the retention apparatus of the present invention as discussed below and as illustrated in the subsequent drawing figures, is given different reference numerals to provide exemplary illustrations of the present invention.

Figure 2:
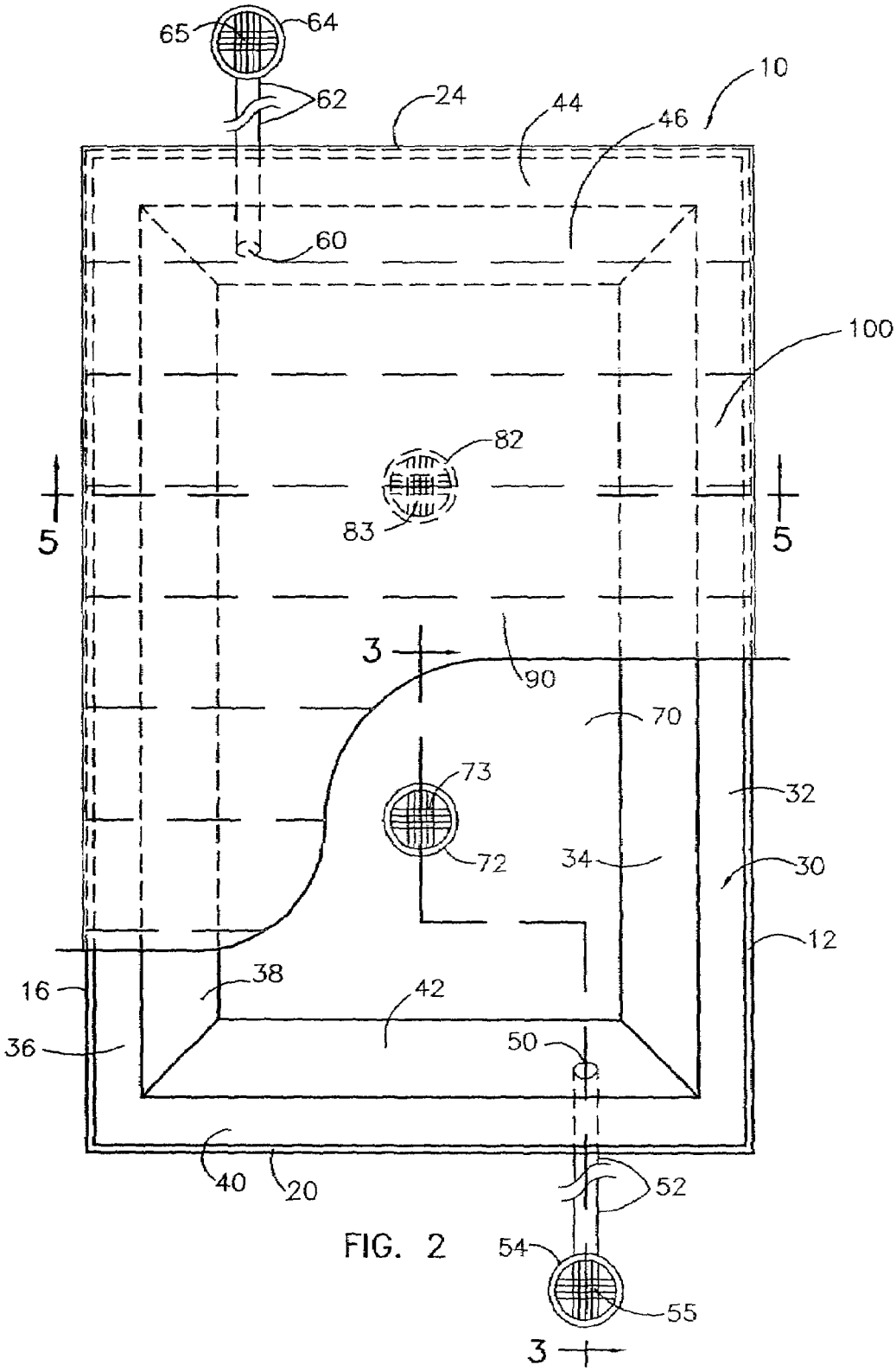
FIG. 2 is a plan view, partially broken away, of the apparatus of the present invention.
Figures 3, 4:
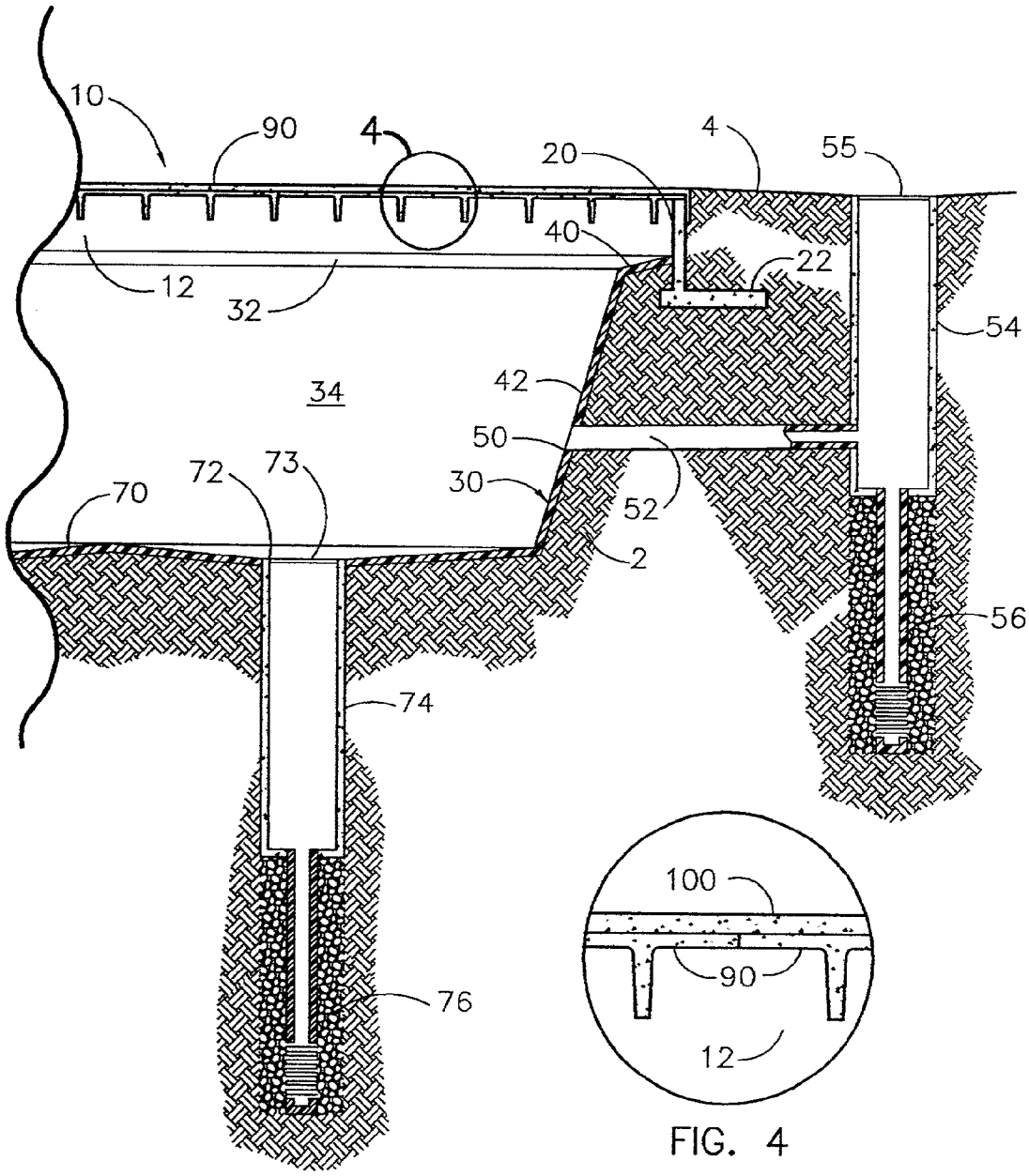
FIG. 3 is a view in partial section taken generally along line 3—3 of FIG. 2.
FIG. 4 is an enlarged view in partial section generally taken from Circle 4 of FIG. 3
Figures 5, 6:
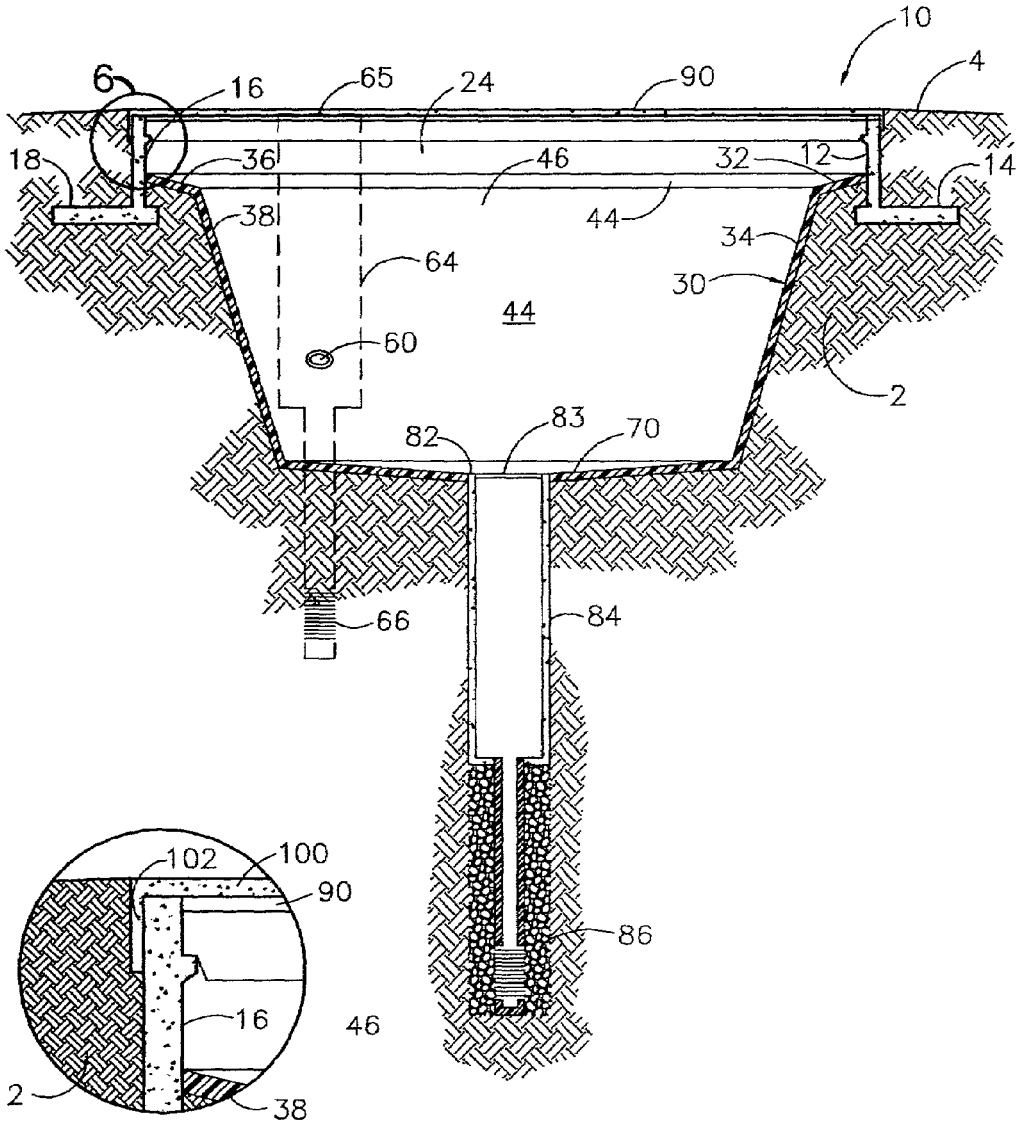
FIG. 5 is a view in partial section taken generally along line 5—5 of FIG. 2.
FIG. 6 is an enlarged view in partial section taken generally from Circle 6 of FIG. 5.

FIG. 2 is a top plan view of water retention or water retaining apparatus 10 of the present invention, partially broken away. FIG. 3 is a view in partial section of the apparatus 10 taken generally along line 3—3 of FIG. 2. FIG. 4 is a view in partial section taken generally from Circle 4 of FIG. 3. FIG. 5 is a view in partial section of the apparatus 10 taken generally along line 5—5 of FIG. 2. FIG. 6 is a view in partial section taken generally from Circle 6 of FIG. 5. For the following discussion of the water retention apparatus 10, reference will generally be made to FIGS. 2, 3, 4, 5, and 6.

The water retention apparatus 10 is disposed within ground 2 and beneath grade 4 of the ground 2. For maximum efficiency of the water retention apparatus 10, the grade 4 will generally be the lowest grade within the area to be protected by the apparatus 10. That is, the apparatus 10 will generally be built at the lowest portion of the site, such as shopping center, mall, etc., in order to collect and to retain water, rain or snow, falling on the site.

The water retention apparatus 10 includes four relatively short retaining side walls 12, 16, 20, and 24. The side walls 12, 16, 20, and 24 are disposed on footings 14, 18, 22, and 26, respectively. The side walls 12 . . . 24 and their respective footings 14 . . . 26 comprise perimeter support elements for the apparatus 10. Obviously, the area occupied by the apparatus 10 is appropriately excavated for the apparatus, including the footings, etc., and contoured to the desired configuration.

For the general configuration, the apparatus 10 is shown as a rectangle, but a square or other appropriate configuration may also be used, all in accordance with the area to be drained of its rain or snow run off and for which the run off is to be retained by the apparatus 10.

Appropriately secured to the side retaining walls 12 . . . 24 is a liner 30. The liner 30 is illustrated as a flexible liner, and it may be a water proof plastic liner, which may also be generally impregnable to other liquids that may come in contact with it. The liner 30 includes generally three portions, including an upper side wall portion extending inwardly and downwardly at a relatively shallow angle, a side wall portion extending inwardly and downwardly at a relatively steep angle, and a bottom portion.

The upper side wall portion is divided into four wall portions which extend inwardly and downwardly from the perimeter retaining walls 12 . . . 24. The upper side wall portions accordingly include an upper side wall 32, an upper side wall 36, an upper side wall 40, and an upper side wall 44. Extending inwardly and downwardly from the upper side walls 32, 36, 40, and 44 are lower side walls 34, 38, 42, and 46, respectively.

From the bottom side wall portions there is a bottom portion 70. While the three portions of the liner 30, with their respective wall portions, are shown as a continuous liner, it is obvious that they may be made in sections and appropriately secured together to achieve the desired results.

On the side wall portion 42 is an opening 50. The opening 50 is appropriately secured to a conduit 52. The conduit 52 extends between the opening 50 and a vertically extending pipe 54. The pipe 54 is adjacent to, but spaced apart from, the retaining wall 20. At the bottom of the pipe 54, below where the conduit 52 connects with the pipe, is a dry well 56. At the top of the pipe 54 is a grate 55. Water run off flows into the pipe 54 through the grate 55 and downwardly into the dry well 56. When the dry well 56 fills up, the excess water then flows through the conduit 52 and into the interior of the water retention apparatus 10 through the opening 50.

On the opposite end wall portion 46 is an opening 60. The opening 60 is appropriately secured to a conduit 62. The conduit 62 extends between the wall portion 46 and a vertically extending pipe 64. At the bottom of the pipe 64, below the juncture of the pipe 64 and the conduit 62, is a dry well 66. At the top of the pipe 64 is a grate 65.

Water flow into the pipe 64, the dry well 66, and the conduit 62 is substantially the same as discussed above for the pipe 54, the dry well 56, and the conduit 52. It will be noted that the level of the openings 50 and 60, with their respective conduits 52 and 62, are different, with the opening 50 and its conduit 52 being below the opening 60 and its conduit 62. The grated vertical pipes 54 and 64 comprise the source of drain water for the apparatus 10. The conduits 52 and 62 preferably have a slight downward pitch from their pipes to their openings 50 and 60, respectively.

While only the two input sources of water are shown, it is obvious that there may be as many input sources as needed, depending on the size of the site, the type of rain or snow run off expected, with respect to heavy or light, the storm frequency, and other variables which may be taken into consideration for a particular site. See, for example, FIG. 1, in which three input sources are shown for the apparatus 7.

The bottom 70 of the liner 30 may be appropriately contoured, if desired or as necessary. At the low points of the bottom 70 are shown two drain apertures, 72 and 82. The drain apertures 72 and 82 include grates 73 and 83, respectively.

A vertically extending drain pipe 74 is appropriately secured to the opening 72, and the pipe 74 extends to a dry well 76. A drain pipe 84 is appropriately secured to the opening 82 and the pipe 84 extends vertically to a dry well 86.

Water retained in the apparatus 10 drains into the pipes 74 and 84 and into their respective dry wells as the water percolates downwardly from the dry wells and into the local aquifer. Again, while only two drain apertures, pipes, and dry wells are illustrated, it is obvious that as many as necessary under the circumstances may be included in the apparatus 10.

Moreover, it is also obvious that the liner 30 may also be "Gunite" or other appropriate material, cementitious or other, whatever is most practical under the circumstances. This is also discussed below.

Supported on the retaining walls 12 and 16 is a top deck of structural tee elements 90, which are made of prestressed, reinforced concrete. The structural tee elements 90 comprise a roof for the basin defined within the walls 12 and 16 and the liner 30 and above the bottom 70 of the liner. The tee elements 90 also comprise structural support for an area which may be used for parking ordinary vehicles, as mentioned above, or for other appropriate use, as mentioned above. Thus, the apparatus 10 serves a dual purpose, providing a water retaining area beneath the structural tee elements 90, and providing useful space on top of the apparatus 10. The structural tee elements 90 are best shown in FIG. 4. The structural tee elements 90 are well known and understood structural elements.

On top of the structural tee elements 90 is a concrete cap 100.

Referring to FIG. 6, a return portion 102 of the cap 100 is shown extending downwardly from the cap 100 and onto the adjacent portion of the retaining wall 16.

For access to the interior of the apparatus 10, there may be provided one or more manholes, with ladders, etc., for cleaning, pumping out or otherwise removing sediment and other items which may, over time, accumulate on the bottom 70. Such items are well known and accordingly are not shown.

Figure 7:
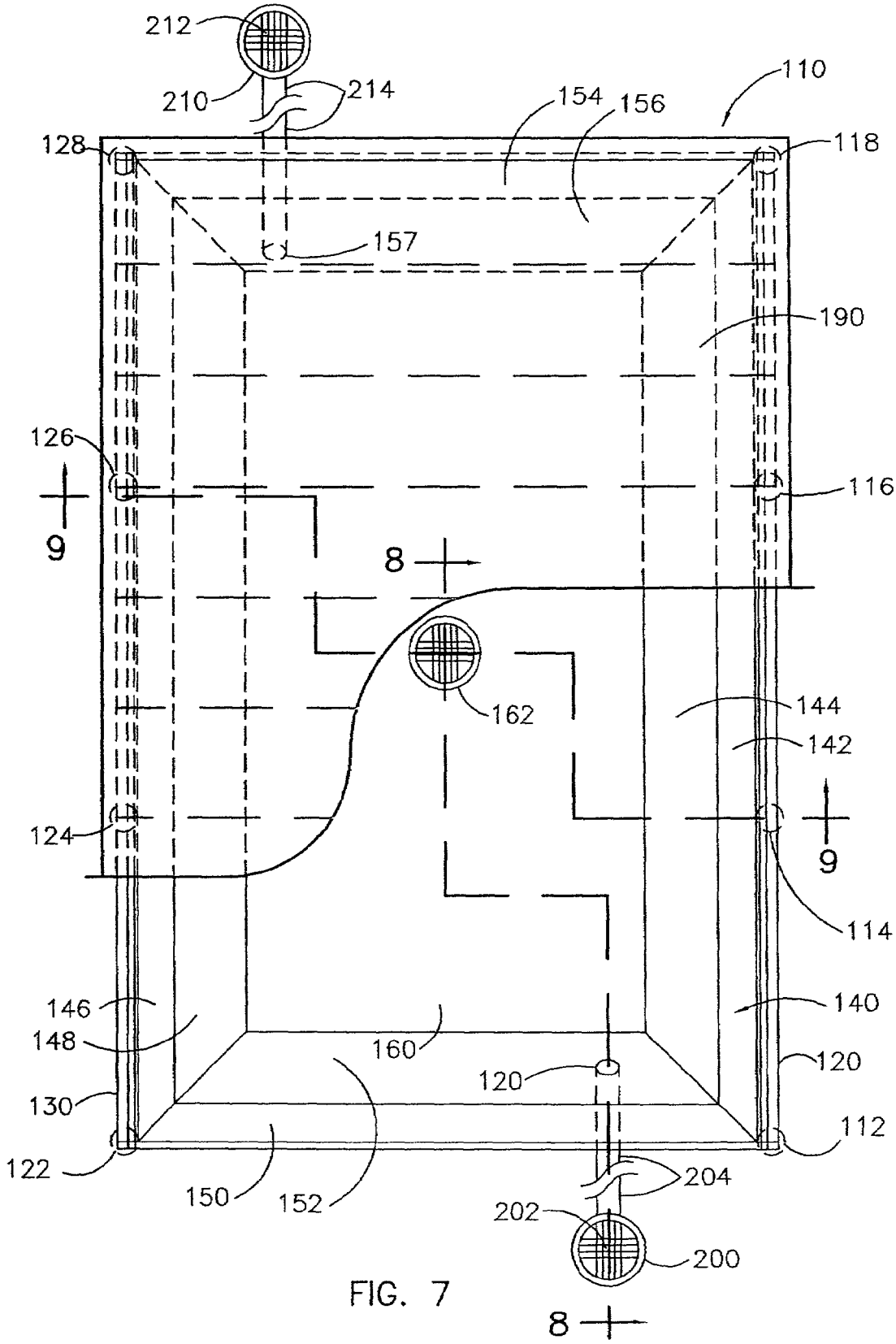
FIG. 7 is a plan view, partially broken away, of an alternate embodiment of the apparatus of the present invention.
Figure 8:
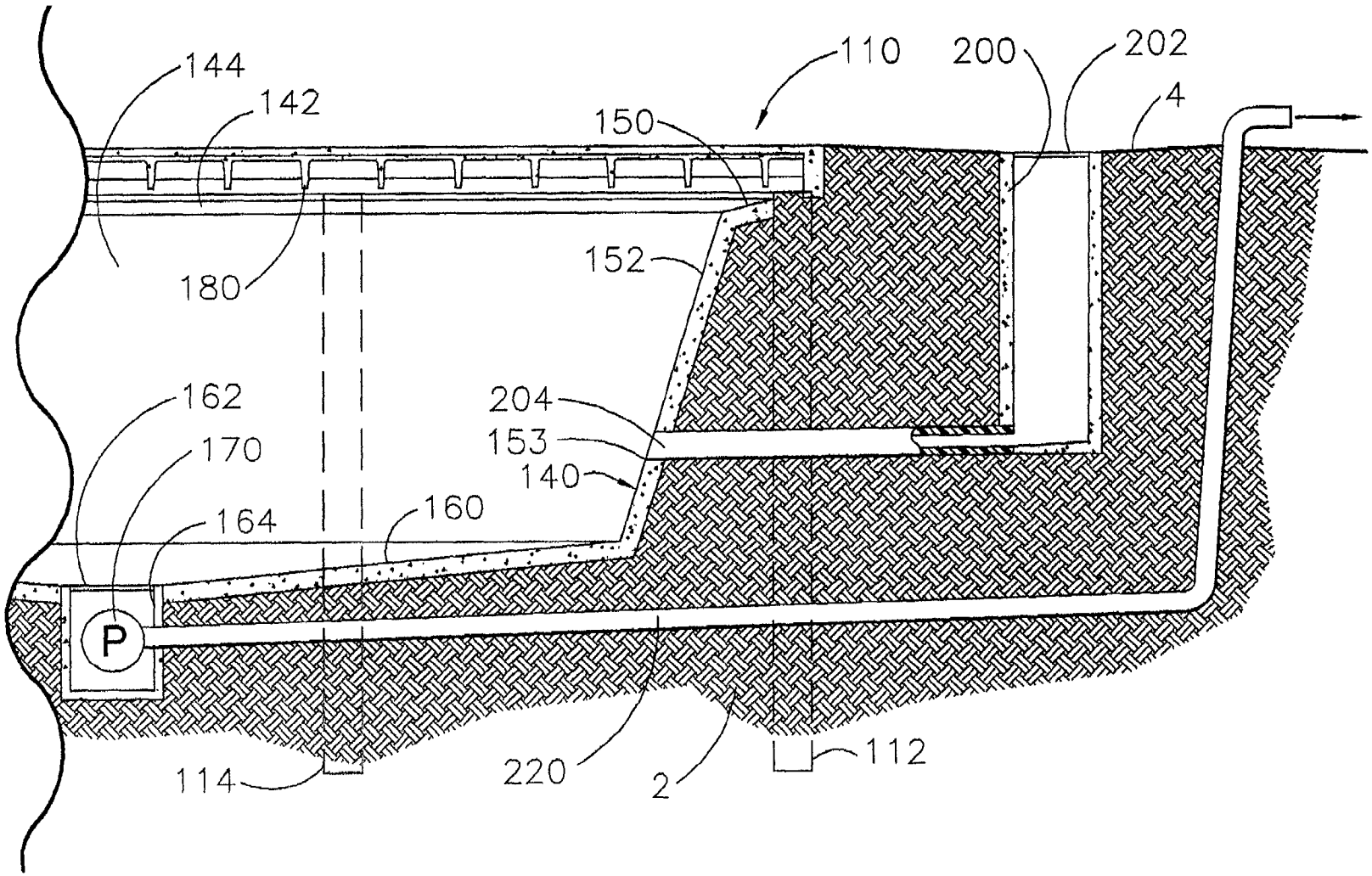
FIG. 8 is a view in partial section taken generally along line 8—8 of FIG. 7.
Figures 9, 10:
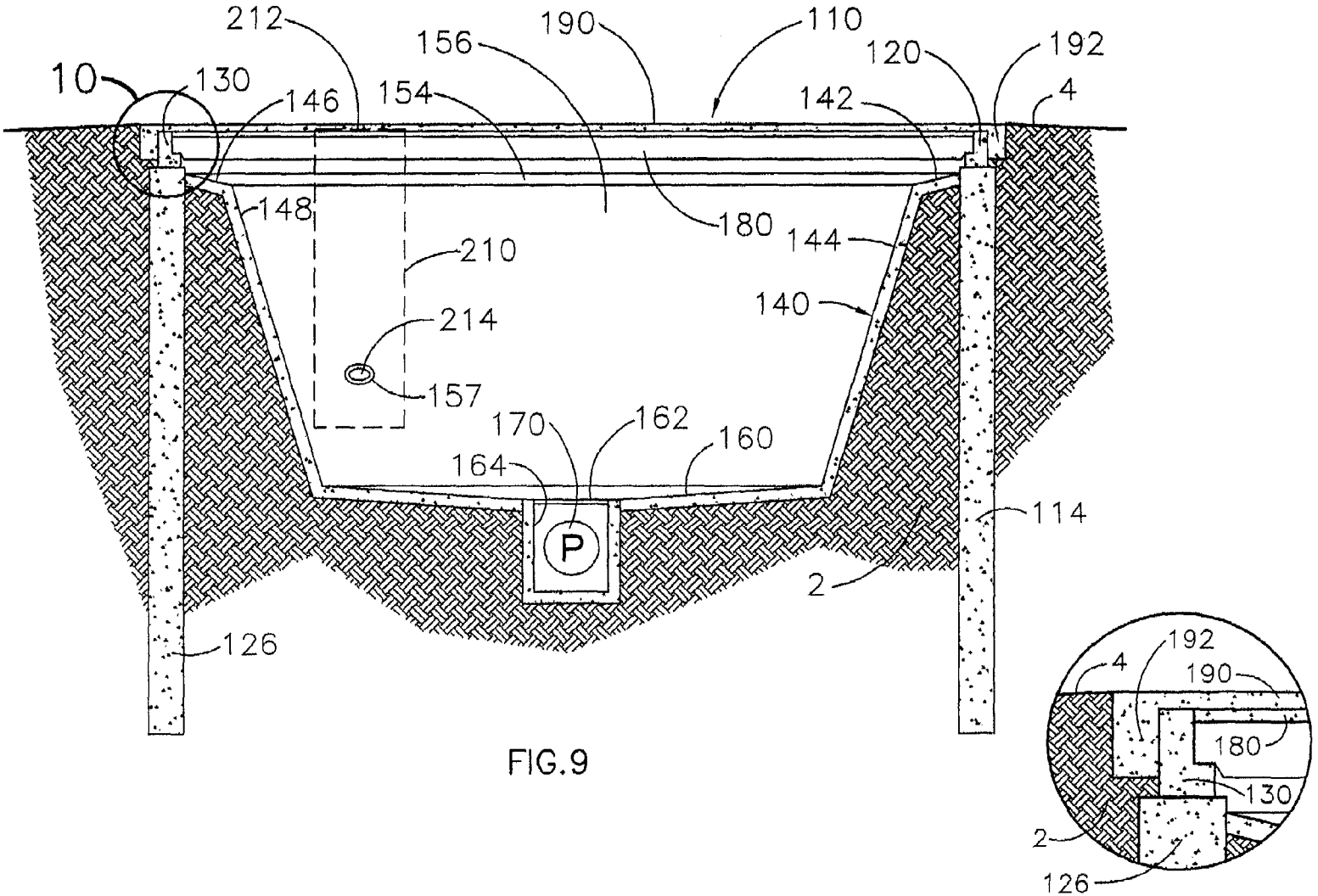
FIG. 9 is a view in partial section taken generally along line 9—9 of FIG. 7.
FIG. 10 is an enlarged view in partial section taken generally from Circle 10 of FIG. 9

An alternate embodiment of the apparatus 10 is illustrated in FIGS. 7, 8, 9, and 10. FIG. 7 is a plan view, partially broken away, of alternate water retention apparatus 110. FIG. 8 is a view in partial section of the apparatus 110 taken generally along line 8—8 of FIG. 7. FIG. 9 is a view in partial section of the apparatus 110 taken generally along line 9—9 of FIG. 7. FIG. 10 is an enlarged view in partial section taken generally from Circle 10 of FIG. 9. For the following discussion, reference will primarily be made to FIGS. 7, 8, 9, and 10.

The apparatus 110, like the apparatus 10, is illustrated as being rectangular in configuration. Again, any desired or appropriate configuration may be employed.

Four caissons 112, 114, 116, and 118 are shown aligned with each other for providing support for an L-beam 120. Four other caissons 122, 124, 126, and 128 are spaced apart from the caissons 112 . . . 118 and are aligned generally parallel to the caissons 112 . . . 118. The caissons 122 . . . 128 support an L-beam 130. The L-beam 130 is generally parallel to the L-beam 120. The caissons and L-beams comprise perimeter support elements or structure for the apparatus 110 and in particular for roof elements for the apparatus, namely structural tee elements, as with the apparatus 10.

As with the apparatus 10, the ground 2 is appropriately contoured to receive a liner 140. The liner 140 is illustrated as being a cementitious liner, but similar to the liner 30 in that it includes several different portions, including an upper portion having a relatively shallow angular slope, a lower portion having a relatively steep angular slope, and a bottom portion 160 which may be contoured as desired to slope to desired pump elements.

The liner 140, being cementitious, such as "Gunite" material, is relatively inflexible, unlike the liner 30. However, the liner 140 is still relatively waterproof and generally protects the perimeter support walls from erosion by the retained or detained run off water.

The relatively shallow sloping upper portion includes upper sides 142, 146, 150, and 154. The relatively steeper sloping lower sides include lower sides 144, 148, 152, and 156.

The bottom portion 160 includes an opening 162 which is appropriately secured to a pipe 164. At the bottom of the pipe 164 is a sump pump 170. The pipe 164 is appropriately grated at the opening 162. The pump 170 is used to pump the run off water retained within the apparatus 110 upwardly and outwardly from the apparatus 110 for appropriate disposition of the water. This will be discussed in detail below.

The liner 140 may be relatively solid or inflexible, as discussed above, or it may be a plastic or other relatively flexible material. Any appropriate material may be used as the liner, as discussed above for the apparatus 10. The ground 2 is contoured to support the liner, as discussed above, regardless of what material is used for the liner.

The L-beams 120 and 130 support a plurality of structural tee elements 180, with comprise the top or roof for the apparatus 110. Details of the relationship between the tee elements 180 and the associated structural elements are best shown in FIG. 10.

The tee elements 180 are structurally sound and strong enough to be used as a parking lot for normal vehicles, as discussed above for the apparatus 10 and the structural tee elements 90. The structural tee elements 180 are substantially the same as the tee elements 90 discussed above for the apparatus 10.

And, like the apparatus 10 and the tee elements 90, there is a concrete cap 190 on the tee elements 180. The cap 190 is, like the cap 100, essentially the top coating for the parking areas 5, shown in the exemplary illustration of FIG. 1, or for some other appropriate use of the area, as mentioned above. And, once again, there is a return portion 192 of the cap 190. The return portion 192 is disposed against the L-beam 130. The top of the tee elements 180, or a surface thereof, is disposed at about the level of grade 4, just as with the tee elements 90 of the apparatus 10.

For providing run off water into the interior of the apparatus 110 there are drain pipes from the grade surface 4. Included is a generally vertically extending pipe 200, with a grate 202, and a sloping pipe 204 which extends to an opening 153 in the wall 152 of the liner 140. There is also a pipe 210, covered by a grate 212, which extends generally downwardly and connects to a sloping pipe 214. The pipe 214 extends to an opening 157 in the wall 156 of the liner 140.

Referring to FIG. 8, there is shown a pipe 220 which extends from the pump 170 outwardly from the apparatus 110. The water collected in the apparatus 110 from the grated pipes 200 and 210 flows downwardly on the liner 140 and into the grated sump pipe 164. From the sump pipe 164, the pump 170 pumps the retained water outwardly through the pipe 220 for appropriate disposition.

Again, man holes and ladders for egress and ingress into the interior of the apparatus 110, like the illustrations of the apparatus 10, have been omitted from the drawing figures. Similarly, electrical power and control elements for the pump 170 have been omitted from the drawing figures. Such items are well known and understood.

The apparatus 110, like the apparatus 10, in addition to receiving and holding run off water, may provide support for a parking lot or other appropriate area to serve a double function for the area at the site which it occupies.

Figure 11:
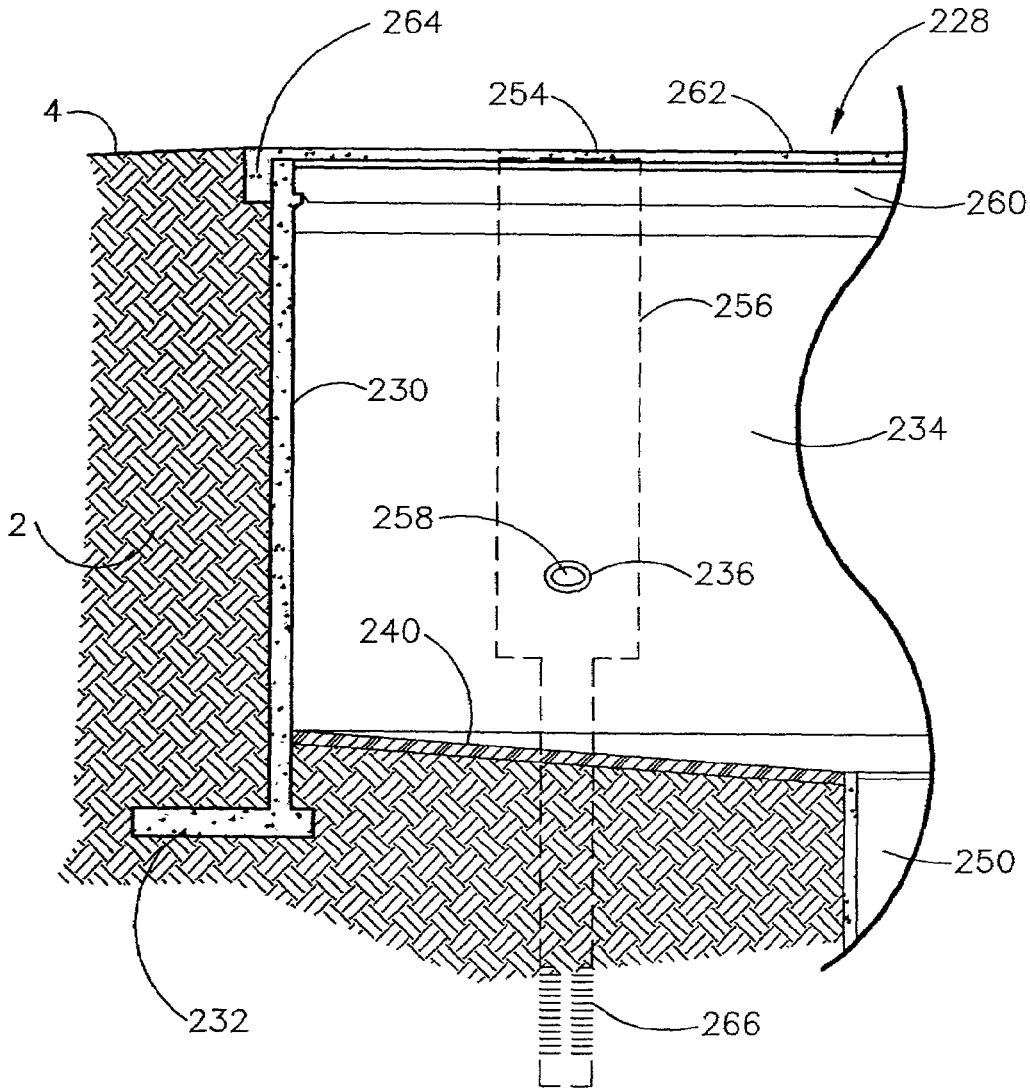
FIG. 11 is a view in partial section of another alternate embodiment of the present invention.

FIG. 11 is a fragmentary view in partial section of an alternate structural support wall apparatus 228 for the apparatus of the present invention. For the apparatus 10 and 110, four relatively short retaining walls 14, 16, 18, and 20, and a plurality of caissons supporting L-beams 120 and 130 were respectively illustrated, with liners 30 and 140 secured to the retaining walls and L-beams, and disposed in the ground 2. In FIG. 11, a generally vertically extending and relatively long support wall 230, disposed on a footing 232, is shown. A liner 240 is shown secured to a lower portion of the wall 230. The liner 240 may be a relatively flexible plastic or elastomeric liner, such as discussed above for the apparatus 10. The liner 240 slants downwardly to a grated central pipe 250, and the pipe 250 may extend to a dry well, such as shown in FIG. 5, or to a pump, as shown in FIGS. 8 and 9.

A second generally vertically extending wall 234 is also shown in FIG. 11. In the wall 234 is an opening 236. The opening 236 communicates with a water input pipe 258 which extends from a generally vertically extending pipe 256. The pipe 256 includes a grated opening 254. A dry well 266 extends below the pipe 256.

The vertically extending wall 230 and its correspondingly opposite wall, not shown, support a plurality of structural tee elements 260, the same as with the other support elements discussed above for the apparatus 10, 110, etc. On top of the structural tee elements 260 is a concrete cap 262, which is substantially the same as discussed above for the embodiments 10 and 110. A return 264 for the cap 262 is shown extending downwardly for a short distance on the wall 230.

Figure 12:
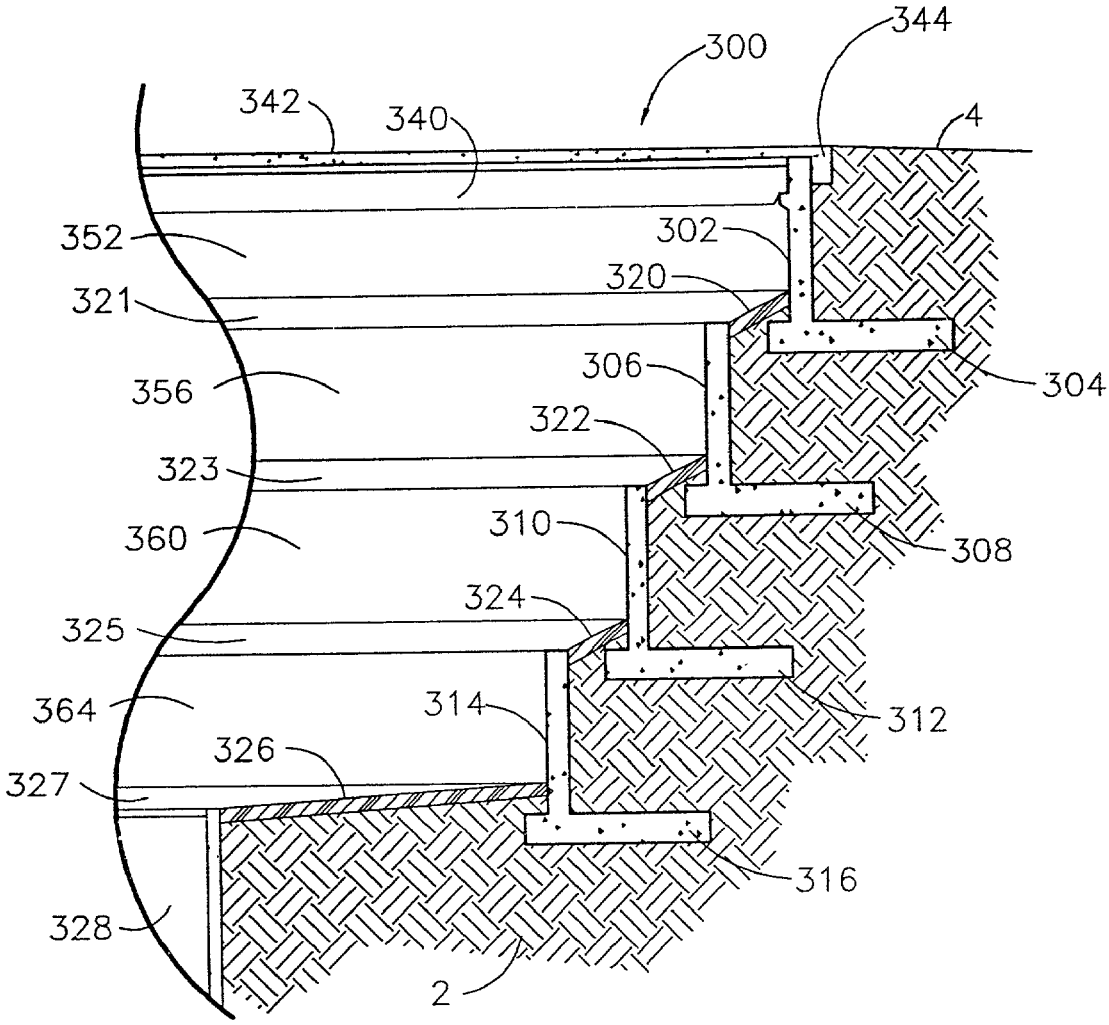
FIG. 12 is a view in partial section of another alternate embodiment of the apparatus of the present invention.

FIG. 12 is a fragmentary view in partial section of another alternate embodiment 300 of structural wall elements for the apparatus of the present invention. A series of relatively short stepped walls is used, with liner elements connecting the stepped walls. Four stepped walls 302, 306, 310, and 314 are shown, and each wall includes a footing. The walls 302, 306, 310, and 314 include footings 304, 308, 312, and 316, respectively. The walls and their footings are stepped inwardly to provide an overall slant to the apparatus 300.

Between the lower portion of the wall 302 and the upper portion of the wall 306 is a relatively short liner portion 320. From the lower portion of the wall 306 another relatively short liner portion 322 extends to the upper portion of the wall 310. Another relatively short liner portion 324 extends from the lower portion of the wall 310 to the upper portion of the lowermost wall 314. A bottom liner 326 is secured to the lower portion of the lowermost wall 314 and slopes inwardly to a central pipe 328.

Four other relatively short stepped walls 352, 356, 360, and 364 are also shown in FIG. 12. The walls 352 . . . 364 also include footings, not shown, substantially like the walls 302 . . . 314. Liner portions 321, 323, 325, and 327 extend between the respective wall portions 352–356, 356–360, 360–364, and from the wall portion 364 downwardly to the pipe 328. The liner portions 321 . . . 327 for the walls 352 . . . 364 are essentially continuations of the liner portions 320 . . . 326. The liner portions may, of course, be other appropriate material than plastic, as illustrated in FIG. 12 by the hatching shown.

While not shown in FIG. 12, it will be understood that there are similar walls for the rest of the perimeter of the apparatus 300, as with the other embodiments discussed above, and that the adjacent wall portions join onto each other, just as the adjacent wall portions in the other embodiments join onto each other to provide appropriate perimeter structural support.

The wall 352 and its opposite wall, not shown, support a plurality of structural tee elements 340, similar to the other embodiments discussed above. On top of the structural tee elements 340 is a top cap 342. A return 344 is shown for the cap 242 extending downwardly on the outer portion of the wall 302.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. Underground water retention apparatus comprising in combination:

means for providing perimeter structural support;

means for holding a quantity of run off water secured to the means for providing perimeter structural support;

means for draining run off water onto the means for holding a quantity of run off water;

means for draining run off water from the means for holding a quantity of run off water; and means for providing a roof for covering the holding means, and for providing structural support for appropriate use of this roof means, disposed on the perimeter structural support means, and including a plurality of tee elements disposed on the means for providing perimeter structural support.

2. The apparatus of claim 1 in which the perimeter structural support means comprises a retaining wall.

3. The apparatus of claim 2 in which the means for draining run off water from the holding means includes a dry well.

4. The apparatus of claim 1 in which the means for draining run off water from the holding means includes a pump.

5. The apparatus of claim 1 in which the perimeter structural support means includes a plurality of caissons.

6. The apparatus of claim 5 in which the perimeter structural support means further includes an L-beam disposed on at least some of the plurality of caissons.

7. The apparatus of claim 5 in which each caisson of the plurality of caissons is spaced apart from each other caisson.

8. The apparatus of claim 7 in which the plurality of spaced apart caissons includes a first row of spaced apart caissons and a second row of spaced apart caissons.

9. The apparatus of claim 8 in which the perimeter structural support means includes a first L-beam disposed on the first row of spaced apart caissons and a second L-beam disposed on the second row of spaced apart caissons.

10. The apparatus of claim 9 in which the plurality of tee elements are disposed on the first and second L-beams.

11. The apparatus of claim 1 in which the plurality of tee elements are disposed adjacent to each other.

12. The apparatus of claim 1 in which the holding means includes an upper side wall portion, a lower side wall portion, and a bottom portion.

13. The apparatus of claim 12 in which the upper side wall portion is disposed at a relatively shallow angle.

14. The apparatus of claim 13 in which the lower side wall portion is disposed at a relatively steep angle.

15. The apparatus of claim 1 in which the holding means comprises a plastic liner.

16. The apparatus of claim 1 in which the holding means is made of cementitious material.

17. The apparatus of claim 1 in which the perimeter structural support means includes a generally vertically disposed retaining wall.

18. The apparatus of claim 17 in which the holding means is secured to the vertically disposed retaining wall.

19. The apparatus of claim 18 in which the retaining wall is relatively short.

20. The apparatus of claim 18 in which the retaining wall is relatively long.

21. The apparatus of claim 1 in which the perimeter structural support means includes a stepped retaining wall.

22. The apparatus of claim 1 in which the perimeter structural support means includes a plurality of relatively short stepped retaining walls.

23. The apparatus of claim 22 in which the holding means is secured to the plurality of relatively short stepped retaining walls.

24. The apparatus of claim 1 in which the roof means further includes a concrete cap disposed on the plurality of structural tee elements.

* * * * *